United States Patent [19]

Summers

[11] Patent Number: 4,776,801

[45] Date of Patent: Oct. 11, 1988

[54] DEVICE TO ASSIST BOWLERS

[76] Inventor: Ted A. Summers, 6714 Addington La., Sylvania, Ohio 43560

[21] Appl. No.: 124,900

[22] Filed: Nov. 24, 1987

[51] Int. Cl.[4] ..... G09B 9/00

[52] U.S. Cl. ..... 434/249

[58] Field of Search ..... 434/249

[56] References Cited

U.S. PATENT DOCUMENTS

| | | | |
|---|---|---|---|
| 2,942,358 | 6/1960 | Pomranz | 434/249 |
| 2,989,810 | 6/1961 | Marting | 434/249 |
| 3,279,097 | 10/1966 | Tomblin, Jr. | 434/249 |
| 4,415,327 | 11/1983 | Green | 434/249 |

*Primary Examiner*—William H. Grieb

*Attorney, Agent, or Firm*—David C. Purdue; John C. Purdue

[57] ABSTRACT

A bowling device comprising a base, at least one transparent overlay, and fasteners for supporting the overlay on the base for limited sliding movement relative thereto is disclosed. A representation of a bowling alley and ten bowling pins is provided on the base. A representation of a path of body travel and a path of ball travel corresponding with one of a variety of bowling styles (i.e. straight ball, hook ball, etc.) is provided on one or more overlays having first and second ends.

Slots are provided in the first and second ends of each overlay, at positions adjacent to the end of the path of ball travel and the beginning of the path of body travel. The slots are oriented substantially transversely to the path of ball travel. Pins are secured to the base so that a portion of each pin engages the edges of the first and second slots. A bowler can position the first and second ends of an overlay corresponding with the bowler's bowling style, so that the representation of the end of the path of ball travel coincides with the point where the bowler desires to have the ball contact the pins. At that time, the device will provide a graphic representation of where the bowler should begin his approach and where the bowler should release the ball for a particular pin set-up.

8 Claims, 1 Drawing Sheet

DEVICE TO ASSIST BOWLERS

BACKGROUND OF THE INVENTION

1. Field of the Invention

This invention is a device which can be used by bowlers to improve their bowling skills and scores. More specifically, this invention is a device which can be used by a bowler attempting to make a strike or pick up a spare, to select a position from which to begin his approach and a position at which he should release the ball, so as to optimize the likelihood that the attempt will be successful.

2. Description of the Prior Art

Many books have been written on the subject of bowling. Some of the books contain diagrams illustrating, for example, how to bowl a strike. Other diagrams have been produced to illustrate where to deliver a bowling ball to pick up a spare for various pin combinations. However, diagrams are static and they are useful only for situations which correspond exactly with the situations illustrated in the diagrams.

There are commercial pinsetting machines designed to provide a visual indication of where a bowler should deliver a second ball, relative to the remaining pins, in order to pick up a spare. However, as many beginning bowlers have learned, knowledge about where a ball should be delivered does not ensure that a bowler will succeed in delivering a bowling ball there. In addition, a bowler needs to know where to begin a delivery and where to release the ball, taking into account such factors as the type of ball the bowler throws (i.e. straight ball or hook), whether the bowler bowls left-handed or right-handed, the number of steps the bowler takes during delivery, etc. If a bowler fails to properly account for these factors it is unlikely that the bowler will be successful, in the short run, in making a particular shot. In the long run, it is unlikely that an unsuccessful bowler able to achieve a level of satisfaction which will sustain the bowler's interest in the sport. This phenomenon occurs all too often as beginning bowlers become frustrated and disenchanted by failure to the extent that they do not continue bowling. Thus, there exists a need for a device which can be used by bowlers, especially beginning and intermediate bowlers, to quickly improve their performance thereby sustaining or even piquing their initial interest in the sport of bowling. Such a device should also be relatively inexpensive to manufacture and easy to use.

SUMMARY OF THE INVENTION

The instant invention is a device comprising a base, at least one transparent overlay, and fasteners for supporting the overlay on the base for limited sliding movement relative thereto. A scaled representation of a bowling alley and ten bowling pins is provided on the base. Representations of paths of body travel and paths of ball travel corresponding with various bowling styles (i.e. straight ball, hook ball, etc.) are provided on the overlays.

A first slot is provided at a first end of each overlay, at a position corresponding with the end of the path of ball travel. The slot is oriented substantially transversely to the path of ball travel. A second, substantially transverse slot is provided on the overlay at a position corresponding with the beginning of the path of ball travel. Pins are provided on the base to engage the edges of the first and second slots. A bowler faced with a particular spare slides the first end of an overlay corresponding with the bowler's bowling style, to a position where the representation of the end of the path of ball travel coincides with the point where the bowler desires to have the ball contact the pins. Then, while maintaining the first end of the overlay in that position, the bowler slides the other end of the overlay until the representation of the path of body travel on the overlay coincides with a desired path of body travel, relative to the representation of the bowling alley carried by the base. At this point, the device will provide a graphic representation of where the bowler should begin his approach and where the bowler should release the ball in order to make the spare.

DETAILED DESCRIPTION OF THE INVENTION

Figure 1:
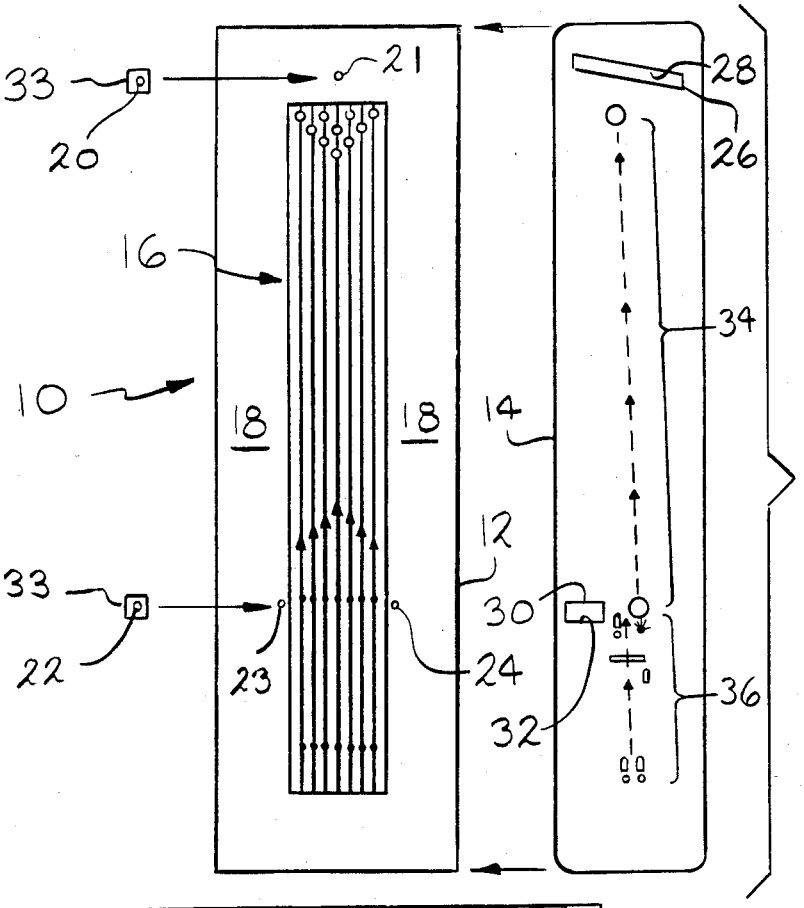
FIG. 1 is top view of a base, fasteners and an overlay according to the present invention.

Referring now to FIG. 1, a device according to the present invention, indicated generally at 10, comprises a base 12 and at least one overlay 14. The base 12 is made from paperboard but can be fabricated from any other suitable material including, but not limited to, plastic, wood and cardboard. A representation of a bowling alley, indicated generally at 16, is provided on the base 12. The representation of the bowling alley 16 can be printed or engraved directly on the base. Alternatively, the representation of the bowling alley 16 can be printed on a sticker or decal (not shown) which, in turn, can be affixed to the base 12. It is preferred that the bowling alley representation 16 be a scaled version of a bowling alley in accordance with the regulations prescribed by the American Bowling Congress. A border 18 surrounds the representation of the bowling alley 16. A pin 20 is provided to be inserted in a hole 21 provided in the border 18 of the base 12 adjacent to the bowling pin end of the bowling alley representation 16. A second pin 22 is provided to be inserted in a hole 23 provided in the base 12 in the border 18 to the left of the foul line region of the bowling alley representation 16. A hole indicated by the reference numeral 24 is provided in the border 18 of the base 12 to the right of the foul line region of the bowling alley representation 16. The hole 24 is adapted to receive the pin 22 in the event that the device 10 is to be used by a left-handed bowler. The connection between the base 12 and the pins 20 and 22 is discussed below in more detail.

Figure 2:
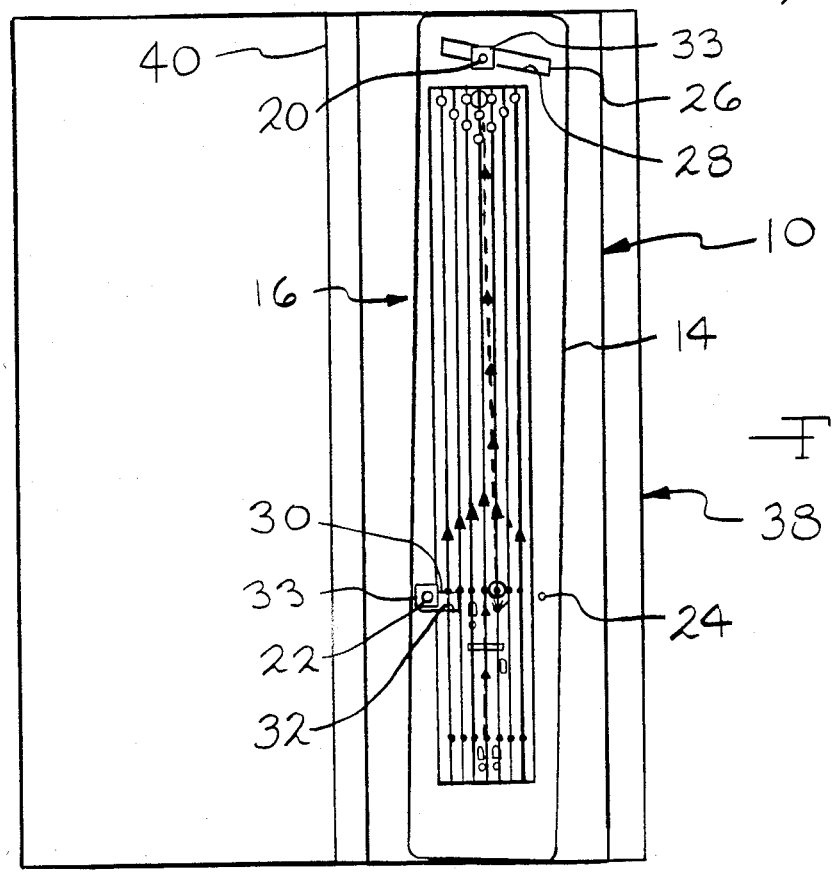
FIG. 2 is a top view of the overlay of FIG. 1 fastened to the base.

The overlay 14 has first and second ends and a length corresponding substantially with that of the base 12. a transverse slot 26 defined by an edge 28 is provided in the overlay 14 adjacent the first end thereof. A second transverse slot 30 defined by an edge 32 is provided in the overlay 14 adjacent the second end thereof. A pair of retainers 33 are supported on the pins 20 and 22, respectively. The retainers 33 are simply square shaped pieces of paperboard provided with a hole adapted to receive the shank of the pin 20 and the pin 22. The heads of the pins 20 and 22 engage the top side of the retainers 33 while the lower sides of the retainers 33 engage the overlay 14 and retain it on the base. This is illustrated in FIG. 2 where the shanks (not shown) of the pin 20 and the pin 22 are behind the base 12. The shanks can be bent until they are coplanar with the base 12 and then secured thereto by tape or another suitable means. Numerous other mechanical connections suitable for slidably retaining the overlay 14 on the base 12 will occur to those skilled in the art and are contemplated to be within the scope of the invention.

The overlay 14, as seen in FIG. 1, carries a representation 34 of a path of ball travel and a representation 36 of a path of body travel during an approach. Other than the representations 34 and 36, the overlay 14 is substantially transparent so that the base 12 can be viewed through the overlay 14. The representation 34 of the path of ball travel includes a representation of two bowling balls: one at the beginning and one at the end of the path of ball travel representation 34. The representation 36 of the path of body travel on the overlay 14 includes representations of feet at the beginning and at the end of the path. In the overlay 14 illustrated in FIG. 1, the representation 34 of the path of ball travel corresponds with a straight ball delivery. It will be appreciated by those familiar with the sport of bowling that ball travel paths corresponding with the other types of deliveries can be represented on additional overlays for use with the base 12 so that the device 10 can be used by all kinds of bowlers.

With reference to FIG. 2, the device 10 is illustrated with the overlay 14 retained on the base 12. The pin 20 is in the slot 26 and the pin 22 is in the slot 30. Relative movement between the overlay 14 and the base 12 is limited by coaction between the pin 20 and a portion of the edge 28 of slot 26, on one hand and the pin 22 and the edge 32 of the slot 30, on the other hand. The representation 16 of the bowling alley carried by the base 12 is visible through the overlay 14.

As illustrated in FIG. 2, the device 10 is set-up for use by a right-handed bowler who bowls a straight ball. As indicated above, other types of deliveries can be represented on overlays otherwise corresponding substantially with the overlay 14. If the device 10 is to be used by a left handed bowler, the overlay 14 should be removed from the base and turned over. The pin 20 and the retainer 33 are then reengaged in the slot 28. The pin 22 or another pin is secured in the hole 24 and the retainer 33 or another retainer is used to engage the slot 30. This adapts the device 10 for use by a left-handed bowler who throws a straight ball.

Also illustrated in FIG. 2 is a cover 38 for the device 10. The cover is scored at 40 to facilitate folding so that the cover 38 can be folded to completely cover and protect the device 10. The base 12 can be glued, taped or otherwise secured to the cover 38. The cover 38 can also serve to retain the bent portions of the shanks of the pins 20 and 22 against the bottom of the base 12.

The device 10 is intended for use by a bowler facing a given shot, i.e., a particular number and arrangement of bowling pins. In order to use the device 10, a bowler would slide the first end of an overlay corresponding with the bowler's bowling style, to a position where the representation of the end of the path of ball travel coincides with the point where the bowler desires to have the ball contact the pins. Then, while maintaining the first end of the overlay in that position, the bowler would slide the other end of the overlay until the representation of the path of body travel on the overlay coincides with a desired path of body travel, relative to the representation of the bowling alley carried by the base and visible through the overlay. At this point, the device 10 will provide a graphic representation illustrating where the bowler should begin his approach and where the bowler should release the ball in order to make the shot, taking into account the factors noted above.

The foregoing description of the invention is intended to be adequate to enable those skilled in the art to practice the invention and, further, to constitute a disclosure of the best mode known to the inventor for carrying out his invention. Accordingly, the disclosure should be construed only as illustrative of the instant invention, which is limited only in accordance with the spirit and scope of the appended claims.

I claim:

1. A device for use by a bowler having a given style of bowling ball delivery, said device comprising, in combination, a base including graphic representations of a bowling alley and bowling pins or their locations, said alley representation having a given width, a substantially transparent overlay having first and second ends, said overlay including a graphic representation, adjacent said first end, of a path of travel for a bowling ball delivered in accordance with the given style of delivery, and further including a graphic representation, adjacent said second end, of a path of body travel during the delivery of a bowling ball in accordance with the given style of delivery, said overlay having slots provided in said first and second ends thereof and pins secured to said base so that a portion of each pin engages an edge of the slots provided in said overlay, thereby retaining said overlay on said base for limited sliding movement relative thereto, wherein the pins and slots are operable to limit movement of said first and second ends of said overlay to substantially linear movement in a direction substantially transverse to the alley representation included on said base.

2. The device claimed in claim 1 and further comprising one or more additional overlays having first and second ends with slots provided in the first and second ends, each overlay including a graphic representation, adjacent said first end, of a path of travel for a bowling ball delivered in accordance with a style of delivery other than the given style, and further including a graphic representation, adjacent said second end, of a path of body travel during the delivery of a bowling ball in accordance with a style of delivery other than the given style.

3. The device claimed in claim 1 wherein said base is fabricated from paper and said overlay is fabricated from plastic.

4. The device claimed in claim 1 wherein the slot provided in the first end of said overlay has a length corresponding with the width of the alley representation.

5. A device for use by a bowler having a given style of bowling ball delivery, said device comprising, in combination, A base including graphic representations of a bowling alley and bowling pins or their locations, said alley representation having a given width, a substantially transparent overlay having first and second ends and a slot provided in the first and second ends, said overlay including a graphic representation, adjacent said first end, of a path of travel for a bowling ball delivered in accordance with the given style of delivery, and further including a graphic representation, adjacent said second end, of a path of body travel during the delivery of a bowling ball in accordance with the given style of delivery and pin means connected to said base for engaging the slots provided in the first and second ends of said overlay to retain said overlay on said base for limited sliding movement relative thereto, wherein said pin means cooperate with the slot in the first end of said overlay to limit movement thereof to substantially linear movement in a direction substantially transverse to the alley representation included on said base and wherein said pin means cooperate with the slot provided in the second end of said overlay to limit movement thereof to substantially linear movement in a direction substantially transverse to the alley representation included on said base.

6. The device claimed in claim 5 and further comprising one or more additional overlays having first and second ends, each overlay including a graphic representation, adjacent said first end, of a path of travel for a bowling ball delivered in accordance with a style of delivery other than the given style, and further including a graphic representation, adjacent said second end, of a path of body travel during the delivery of a bowling ball in accordance with a style of delivery other than the given style.

7. The device claimed in claim 5 wherein said base is fabricated from paper and said overlay is fabricated from plastic.

8. A device comprising, in combination, a base including graphic representations of a bowling alley and bowling pins on their locations, said alley representation having a given width, a plurality of substantially transparent overlays having first and second ends and a slot provided in the first and second ends, each of said overlays including a graphic representation, adjacent said first end, of a path of travel for a bowling ball delivered in accordance with a different style of delivery, and further including a graphic representation, adjacent said second end, of a path of body travel during the delivery of a bowling ball in accordance with a different style of delivery and pin means connected to said base for engaging the slots provided in the first and second ends of each of said overlays to retain it on said base for limited sliding movement relative thereto, wherein said pin means cooperate with the slot in the first end of each of said overlays to limit movement thereof to substantially linear movement in a direction substantially transverse to the alley representation included on said base and wherein said pin means cooperate with the slot provided in the second end of each of said overlays to limit movement thereof to substantially linear movement in a direction subtantially transverse to the alley representation included on said base.

* * * * *